US007540903B2

(12) United States Patent
Ladrech et al.

(10) Patent No.: US 7,540,903 B2
(45) Date of Patent: Jun. 2, 2009

(54) DEVICE FOR IONIZING PARTICLES CARRIED IN AN AIRFLOW, FOR VENTILATION, HEATING, AND/OR AIR-CONDITIONING SYSTEM IN PARTICULAR

(75) Inventors: Frederic Ladrech, Maurepas (FR); Didier Loup, Maurepas (FR)

(73) Assignee: Valeo Systems Thermiques, S.A.S., Le Mesnil St. Denis Credex (FR)

( * ) Notice: Subject to any disclaimer, the term of this patent is extended or adjusted under 35 U.S.C. 154(b) by 360 days.

(21) Appl. No.: 11/495,503

(22) Filed: Jul. 28, 2006

(65) Prior Publication Data

US 2007/0028775 A1 Feb. 8, 2007

(30) Foreign Application Priority Data

Aug. 3, 2005 (FR) ..... 05 08302

(51) Int. Cl.
*B03C 3/41* (2006.01)

(52) U.S. Cl. ..... 96/83; 96/89; 96/96

(58) Field of Classification Search ..... 96/83, 96/89–93, 96

See application file for complete search history.

(56) References Cited

U.S. PATENT DOCUMENTS

| | | | | | |
|---|---|---|---|---|---|
| 2,711,224 | A | * | 6/1955 | Herber | 96/89 |
| 2,999,561 | A | * | 9/1961 | Phyl | 96/89 |
| 3,149,937 | A | | 9/1964 | Revell | |
| 3,703,799 | A | * | 11/1972 | Humphreys | 96/91 |
| 3,943,418 | A | * | 3/1976 | Quang | 361/230 |
| 4,134,040 | A | * | 1/1979 | Klotzman | 313/271 |
| 4,202,674 | A | | 5/1980 | Rodenberger et al. | |
| 4,349,359 | A | * | 9/1982 | Fitch et al. | 96/90 |
| 4,360,367 | A | | 11/1982 | Prior | |
| 4,473,383 | A | * | 9/1984 | Bonser et al. | 96/91 |
| 4,514,780 | A | | 4/1985 | Brussee et al. | |
| 5,290,343 | A | | 3/1994 | Morita et al. | |
| 6,048,385 | A | | 4/2000 | Koide | |
| 6,156,104 | A | * | 12/2000 | Jeong | 96/88 |
| 7,238,225 | B2 | * | 7/2007 | Hong et al. | 96/69 |
| 2006/0070526 | A1 | * | 4/2006 | Hong et al. | 96/69 |

FOREIGN PATENT DOCUMENTS

| | | | | | |
|---|---|---|---|---|---|
| GB | 1 559 629 | A | | 1/1980 | |
| GB | 2 045 647 | A | | 11/1980 | |
| GB | 2 112 305 | A | | 7/1983 | |
| GB | 2 308 320 | A | | 6/1997 | |
| JP | 4-171064 | A | * | 6/1992 | 96/96 |
| JP | 06 166325 | | | 9/1994 | |
| JP | 08 332411 | | | 4/1997 | |
| JP | 11 000576 | | | 4/1999 | |

* cited by examiner

*Primary Examiner*—Richard L Chiesa
(74) *Attorney, Agent, or Firm*—Howard & Howard Attorneys PLLC

(57) ABSTRACT

The object of the invention is a device for ionizing (2) particles carried in an airflow (4) circulating inside a system, this device (2) including at least two electrodes (8, 9) held by a chassis (13) and connected, respectively, to the corresponding terminals (10, 11) of a polarized electrical power supply. Two adjacent first electrodes (8) are arranged on either side of a second electrode (9), which is formed from at least one conductor cable (14). The latter (14) is hooked onto fingers (15) that are designed as an elastic part for tensioning the conductor cable (14) and that are held by the chassis (13).

20 Claims, 6 Drawing Sheets

DEVICE FOR IONIZING PARTICLES CARRIED IN AN AIRFLOW, FOR VENTILATION, HEATING, AND/OR AIR-CONDITIONING SYSTEM IN PARTICULAR

TECHNICAL FIELD OF THE INVENTION

This invention belongs to the field of apparatus for treating an airflow circulating through a system, in particular for removing particles from it that it is carrying. This system, for example, is a ventilation, heating and/or air conditioning system, in particular for a motor vehicle. More particularly, the object of this invention is a device for ionizing said particles, with a view to causing their electrostatic precipitation on a collecting device placed downstream from the ionizing device of the invention.

PRIOR ART

Electrostatic apparatus are known that are designed for retaining particles, such as particles of dust, smoke or the like, which are present in an airflow circulating inside a system. These apparatus, for example, are used to purify the air of a ventilation, heating and/or air conditioning system, in particular for a motor vehicle.

Among these apparatus are also known those whose design separates into two separate units an ionizing device designed to electrically charge the particles present in the airflow and a device for collecting the charged particles by electrostatic precipitation. The ionizing device comprises at least one pair of electrodes that are connected to the corresponding terminals of a polarized electrical power supply. The particles present in the airflow circulating between the electrodes are ionized by a high-voltage discharge, either positive or negative, released between the electrodes. The ionized particles are then carried by the airflow towards the collecting device, which is placed downstream from the ionizing device, in order to retain the previously charged particles by means of electrostatic precipitation. A pulser is associated with the ionizing device and the collecting device in order to generate the airflow. For example, the documents GB2308320 (PIFCO LIMITED), GB1559629 (NISSAN MOTOR), JP6166325 (ZEXEL CORP and all), JP11000576 (ZEXEL CORP) and JP8332411 (ZEXEL CORP) describe such apparatus, which have the advantage of separating the ionizing device and the collecting device into two separate units, in order to ultimately reduce the spatial requirements of the ionizing device and increase the performance levels of the collecting device.

According to GB2308320, one of the electrodes is in the shape of a wire whereas the other electrode consists of a plate. According to the documents GB1559629, JP1100576 and JP833241, the electrodes consist of wires oriented orthogonally to the airflow, which are arranged between plates oriented parallel to the airflow.

Ionizing devices such as this use a significant number of elements the assembly of which must be accurate and precise, in particular as concerns the relative positioning of the electrodes. This results in a difficulty in obtaining these devices at a competitive price, along with a compact design and a limited number of elements.

OBJECT OF THE INVENTION

The purpose of this invention is to propose a device for ionizing particles carried in an airflow, which is designed to be placed therein, upstream from a device for collecting these particles, in particular by means of electrostatic precipitation or the like. More particularly, it is sought to propose such a device, which is compact and structurally simple, in order to facilitate its industrial production and simplify the operations for assembling the elements of which it is made.

The device of the invention is a device for ionizing particles carried in an airflow circulating inside a system, such as a ventilation, heating and/or air conditioning system. This device includes at least two electrodes held by a chassis and connected respectively to the corresponding terminals of a polarized electrical power supply. Two first adjacent electrodes are arranged on either side of a second electrode, which is formed from at least one conductor cable.

According to this invention, the conductor cable is hooked onto fingers that are designed as an elastic part for tensioning the conductor cable and that are held by the chassis. According to one embodiment, the fingers are designed in the form of a flexible strip.

More particularly, the fingers advantageously comprise lateral flanges for engaging and supporting the conductor cable, these flanges being provided, in particular, with at least one pin for holding the conductor cable and/or at least one notch for receiving the conductor cable. Preferably, on their outside face, the fingers comprise a flexible center strip against which the conductor cable rests. Such fingers advantageously constitute parts for positioning and holding the conductor cable with regard to the distance separating two adjacent first electrodes.

According to one preferred embodiment, the conductor cable extends from one edge to the other of the chassis, forming at least one loop whose strands each constitute a second electrode. More particularly, and according to a first embodiment, there are a plurality of conductor cables and each forms a closed loop that extends from one edge to the other of the chassis. Even more particularly, and according to a second embodiment, the conductor cable is successively sent back and forth from one edge to the other of the chassis while forming a plurality of open loops.

The hooking fingers of at least one same end of the loops are preferably assembled together on the same support held by the chassis. More particularly, the hooking fingers of the ends of the loops situated at the same side of the chassis are assembled together on one support, the respective supports of the ends of the loops being either separate or consisting of a unitary piece. The support is advantageously added on to the chassis by nesting, such as inside of a first groove that the latter comprises. According to other forms of adding the support onto the chassis, this connection is made by welding, clipping, gluing or similar techniques.

Preferably, the first electrodes are each made in the form of a plate arranged in an overall perpendicular direction to the direction of the airflow, the width of the first electrodes running parallel to the airflow. In particular, there are a plurality of first electrodes and they are joined together at their ends by cross-pieces held by the chassis. The first electrodes and the cross-pieces advantageously consist of a unitary piece, which is capable of being easily made from a stamped blank, or else by means of molding. Preferably, said unitary piece is added onto the chassis by means of nesting. According to the other forms of adding the unitary piece on to the chassis, this addition is accomplished by welding, clipping, gluing or similar techniques. Advantageously, the cross-pieces further consist of means of centering said unitary piece on the chassis. Said unitary piece is preferably added onto the chassis by nesting the ends of the first electrodes inside second grooves made in the chassis.

In particular, the chassis is made in the form of a frame receiving the support at one of its large surfaces, and the unitary piece at its other large surface. In the case where the supports constitute a unitary piece from one end to the other of the loop ends, the wires are capable of being installed on this unitary piece prior to being put in place on the chassis. From these arrangements, it follows that the assembly of the first electrodes and the second electrodes on the chassis is simple and fast, based on their installation on either side of the chassis, by means of an intermediate element onto which the first electrodes and second electrodes are respectively assembled, this intermediate element being formed by the cross-pieces, in the case of the first electrodes, and by the supports, in the case of the second electrodes.

In particular, the chassis is electrically insulating, and is capable of being integrated into a functional unit of the system, such as a filter, for example.

According to another embodiment, the chassis is housed inside of a frame. This frame is preferably composed of two basic frames, at least one of which advantageously comprises at least one harness for holding the first electrodes at a separation distance one from the other. The harness is more particularly arranged at the center area of the first electrodes, in order to further hold them in position as provided by the nesting of their ends inside of the two grooves that the chassis comprises. The chassis is capable of being integrated into a functional unit of the system, such as the frame of a particle filter, or of a device for collecting the particles by electrostatic precipitation.

The ionizing device is capable of being associated with a device for collecting the particles by electrostatic precipitation and with a pulser generating the airflow, or also even with a particle filter, which are advantageously consolidated inside a common housing.

The device of the invention is applicable, in particular, to a primary ventilation, heating and/or air conditioning system equipping a vehicle in particular. The device of the invention is also applicable to a self-contained ventilation, heating and/or air conditioning system for purifying the air in the passenger compartment of a vehicle, which is separate from a primary ventilation, heating and/or air conditioning system equipping a vehicle.

BRIEF DESCRIPTION OF THE FIGURES

This invention will be better understood, and details thereof will become apparent, upon reading the description of it, which will be made in relation to the figures of the appended drawings, in which.

DETAILED DESCRIPTION OF THE INVENTION

Figure 1:
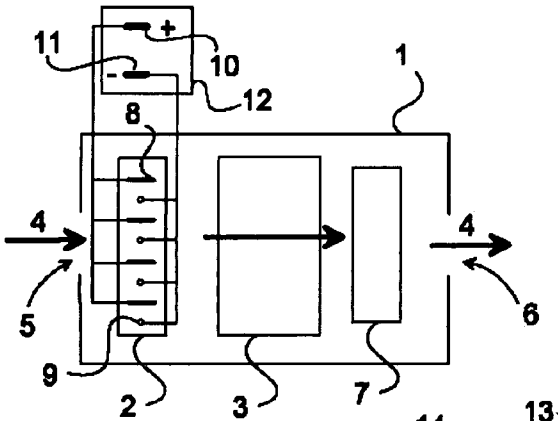
FIG. 1 is a schematic sectional view of a housing containing an apparatus designed to treat an airflow by electrostatic precipitation of the particles that it is carrying.

In FIG. 1, a housing 1 contains an electrostatic apparatus 2, 3 designed to purify an airflow 4 circulating therethrough, by retaining the particles carried in the airflow 4, such as particles of dust, smoke or the like. This apparatus 2, 3 includes an ionizing device 2 designed to electrically charge the particles and a device for collecting 3 the previously charged particles, e.g., by means of electrostatic precipitation. The housing 1 comprises an air inlet 5 and an air outlet 6, and contains a pulser 7 for circulating the airflow 4 through the electrostatic apparatus 2, 3. The housing 1 is likely to be that of a ventilation, heating and/or air conditioning system of a motor vehicle in particular. In this case, the pulser 7 is either that belonging to the system or an additional pulser. In this case again, the electrostatic apparatus 2, 3 is preferably placed at the air inlet 3 of the system or inside the ventilation, heating and/or air conditioning system, either upstream or downstream from the pulser 7. The housing 1 is also capable of being a stand-alone housing placed inside the passenger compartment of the vehicle, in order to purify the air contained therein.

The ionizing device 2 includes electrodes 8, 9 divided into two sets, including a set of first electrodes 8 and a set of second electrodes 9 that are connected, respectively, to the corresponding terminals 10, 11 of a polarized electrical power supply 12. The particles present in the airflow 4 circulate between the first 8 and second 9 electrodes, which release an either positive or negative Corona-type high-voltage discharge. This discharge produces ions that collide with the particles and electrically charge them.

Each first electrode 8 is made in the form of a plate while each second electrode 9 is made in the form of a cable. The first electrodes 8 are arranged, in their overall plane, perpendicularly to the direction of the airflow 4, the width of the first electrodes 8 running parallel to the airflow 4, the second electrodes 9 being interposed between two adjacent first electrodes 8. In the exemplary embodiment shown in FIG. 1, the first electrodes 8 are connected to the positive terminal 10 of the electric power supply 12 and constitute anodes, while the second electrodes 9 are connected to the negative terminal 11 of said supply 12 and constitute cathodes. The wiring of the first 8 and second 9 electrodes is equally capable of being inverted so that the first electrodes 8 constitute the cathodes and the second electrodes 9 constitute the anodes.

Figure 3:
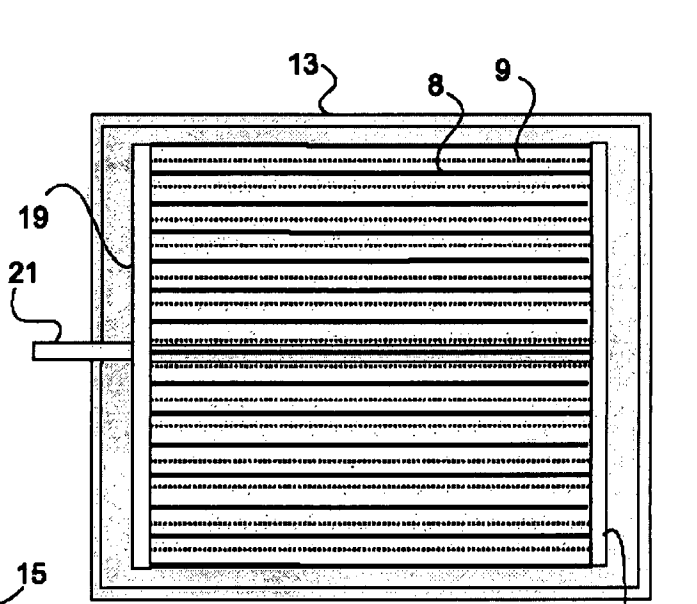
FIG. 2 and FIG. 3 are schematic views of the top and bottom, respectively, of an ionizing device according to the invention.
Figure 2:
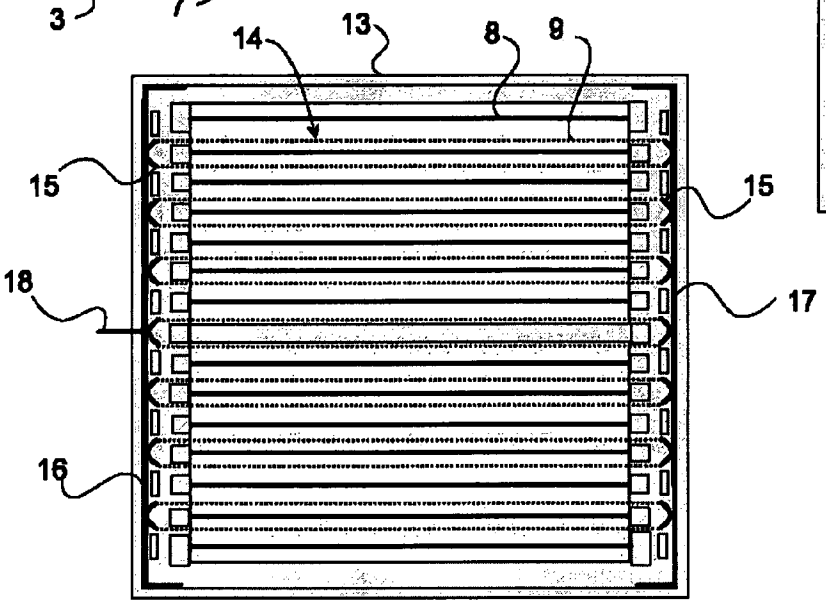

In FIGS. 2 and 3, the first 8 and second 9 electrodes are jointly held by a chassis 13 made in the form of a frame and are arranged parallel to each other within the overall plane of the chassis 13. The chassis 13 is arranged inside the housing 1 in a substantially orthogonal direction to the airflow, so that the latter passes through the interior capacity of the chassis 13 wherein the electrodes 8, 9 are arranged. The chassis 13 is made by molding an electrically insulating material, in particular a plastic material, in order to prevent electrical contact between the first 8 and second 9 electrodes, despite their being added on to a common chassis 13.

In FIG. 2, each of the two electrodes 9 consists of one strand of a loop 14 made by abutting the free ends of a conductor wire. The loop 14 thus formed comprises two parallel strands each constituting a second electrode 8. The two strands of the same loop 14 are arranged on either side of a first electrode 8 made in the form of a plate, so that the way in which the first 8 and second 9 electrodes are arranged in relation to each other consists of an alternating loop strand and plate.

The ends of the loops 14 are hooked on to a respective finger 15 that is held by the chassis 13. The hooking fingers 15 of the same loop end 14 are assembled together on a support 16, 17. Each support 16, 17 and the fingers 15 that it holds respectively constitute a unitary piece made from an electrically conductive material. This means that the second electrodes 9 are electrically interconnected by means of the unitary piece, so that the electrical power supply for all of the second electrodes 9 is provided by a single electrical connection 18 of any one of the supports 16, 17 to the corresponding terminal 11 of the power supply 12. According to another alternative embodiment, the supports 16, 17 allocated, respectively, to each of the loop ends 14 are interconnected so as to form a one-piece unit.

In FIG. 3, the first electrodes 8, made in the form of a plate, are joined together at their ends by means of a respective cross-piece 19, 20. The first electrodes 8 and the cross-pieces 19, 20 are made of an electrically conductive material, in particular steel or the like. The first electrodes 8 are electrically interconnected by means of the cross-pieces 19, 20, so that the electrical power supply for all of the first electrodes 8 is provided by a single electrical connection 21 of any one of the cross-pieces 19, 20 to the corresponding terminal 10 of the power supply 12.

Figure 4:
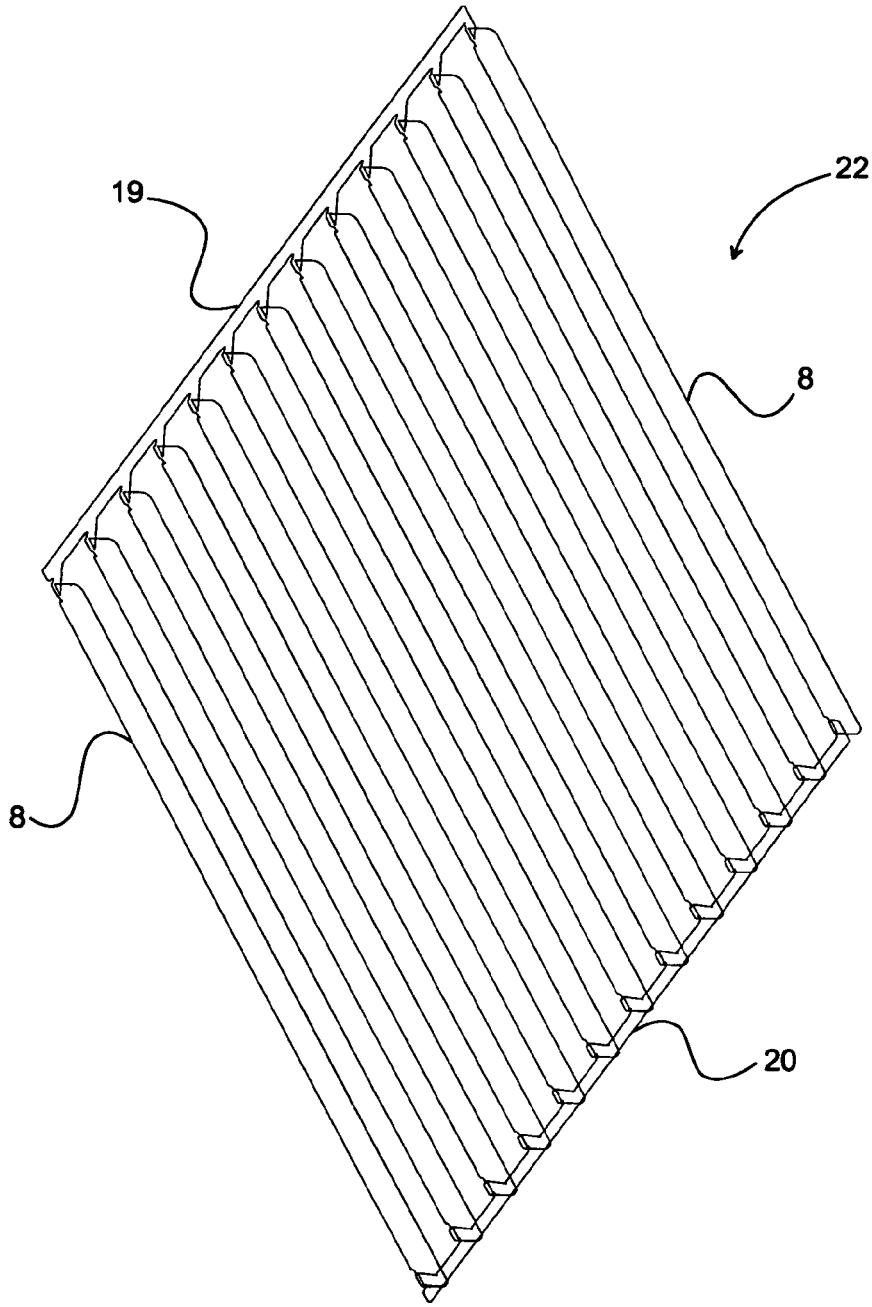
FIG. 4 is a schematic perspective view of a first set of electrodes included in the ionization device shown in FIGS. 2 and 3.

In FIG. 4, the first electrodes 8 and the cross-pieces 19, 20 are made from a metal strip 22. The latter 22 is stamped in order to accommodate the first electrodes 8 and orient them in a substantially orthogonal direction to the cross-pieces 19, 20. Since the cross-pieces 19, 20 and the first electrodes 8 consist of a unitary piece, the precision with which the first electrodes 8 are positioned in relation to each other is optimized, and obtained at the moment said unitary piece is manufactured, in order to dispense with having to perform such positioning during assembly of the ionizing device 2.

In FIGS. 5 to 8, the hooking fingers 15 are elastically deformable in order to enable tensioning of the loops 14. Each finger 15 is designed as a flexible U-shaped strip whose lateral flanges 23 are oriented towards the grooving in the chassis 13. Each lateral flange 23 is provided with a holding pin 25 at its distal end 24 and with a notch 26 at its center area, which are designed to hold the strand of the corresponding loop 14 in position. A flexible tab 27 is arranged at the center area of the finger 15 and on its external face 28. This flexible tab 27, against which the corresponding end of the loop 14 comes to bear, consists of a tensioning part for the latter 14. The fingers 15 advantageously constitute elements for positioning the two electrodes 9 at a separation distance from each other, which is precise and determined by the distance arranged between the distal ends 24 of the lateral flanges 23. This means that the loop design structure of the second electrodes 9, and their being held in shape by fingers 15 assembled together on the same support 16, 17, enables relative, reliable and accurate positioning of the second electrodes 9, based on the structural design of the supports 16, 17.

The support 16, 17 holding the fingers 15 is nested inside of a first groove 29 made in the chassis 13 and opening out at the top surface of the latter 13. The support 16, 17 comprises lateral tabs 30 for positioning on the chassis 13, which are oriented orthogonally to its extended overall plane. These arrangements make it possible to accurately and easily position the support 16, 17 on the chassis 13 during its assembly. The accurate positioning of the support 16, 17 on the chassis 13 thereby enables accurate positioning of the second electrodes 9 in relation to the latter 13.

The end of each first electrode 8 is nested inside a second groove 31 made in the chassis 13 and opening to the face of the underside of the latter 13. More precisely, the ends of the first electrodes 8 are nested inside of respective hubs 32 that the chassis 13 comprises. Such hubs 32 enable the first electrodes 8 to be accurately and easily positioned on the chassis 13, during assembly of said unitary piece 8, 19, 20 on the latter 13.

Two successive hubs 32 are separated from each other by a space 33 left open in order to allow passage of a second electrode 9. From these arrangements, it follows that an ionizing device 2 such as this has reduced spatial requirements, in particular with regard to its axial extension into the airflow 4. As a matter of fact, within the same thickness of the frame forming the chassis 13, the latter contains both said unitary piece 8, 19, 20 and the supports 16, 17.

Finally, as a result of the accurate positioning on the chassis 13 of, on the one hand, the first electrodes 8 and, on the other hand, the second electrodes 9, there is an equally accurate positioning of the electrodes 8, 9 relative to one another, based on simple operations for assembling the supports 16, 17 onto the chassis 13 on one of its large surfaces, and for assembling the unitary piece 8, 19, 20 onto the chassis 13 on its other large surface. The supports 16, 17, on the one hand, and the cross-pieces 19, 20, on the other hand, constitute intermediate elements on which the second electrodes 9 and the first electrodes 8 are respectively assembled together. These arrangements not only enable accurate and reliable positioning during the manufacture of the elements making up the ionizing device 2, but also accurate and reliable positioning of the electrodes 8, 9 of one set in relation to the other, based on the respective assembly of the supports 16, 17 and the intermediate piece onto the chassis 13. The accuracy of such a positioning makes it possible to easily prevent contacts causing inappropriate electrical discharges between the first 8 and second 9 electrodes and malfunctioning of the ionizing device 2.

Figure 5:
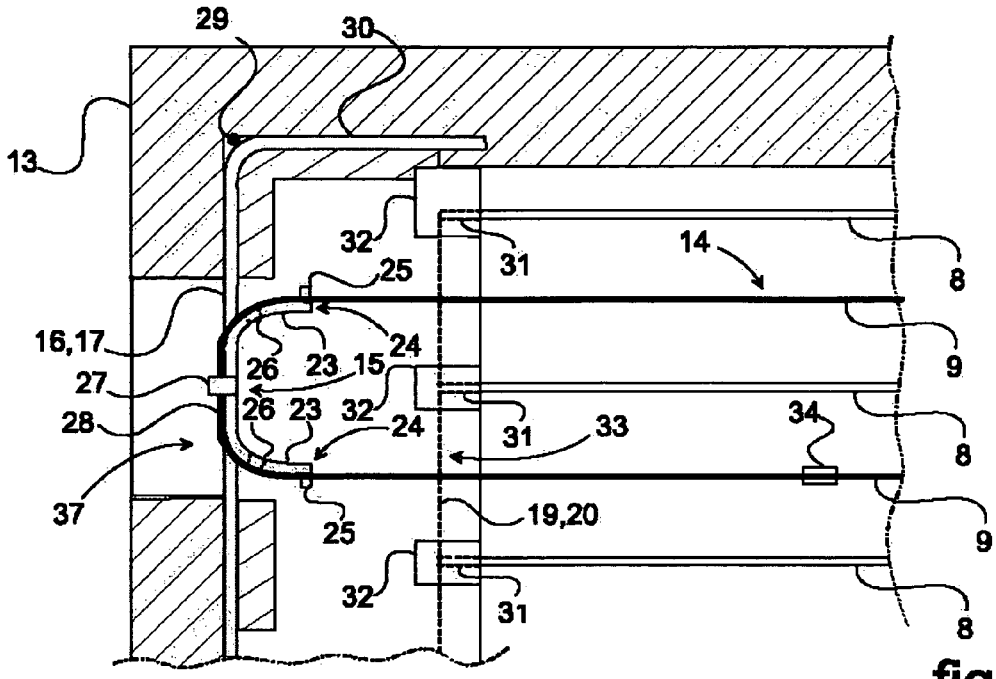
FIG. 5 shows a detail of FIG. 2, as seen from above.
Figure 6:
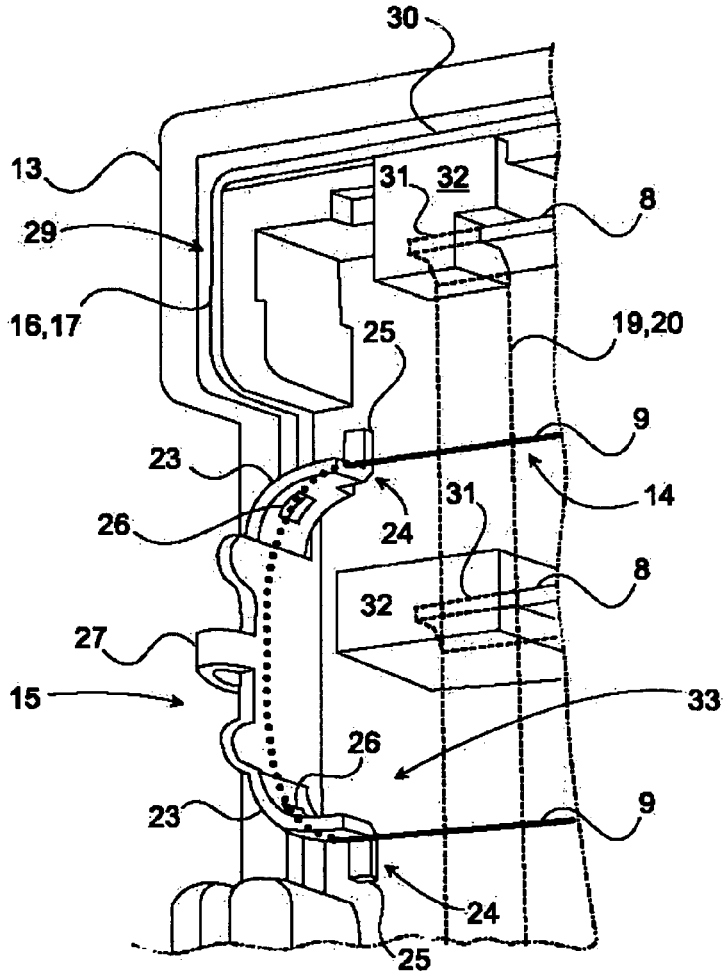
FIGS. 6 and 7 show details of FIG. 2, as perspective top and side views, respectively.
Figure 7:
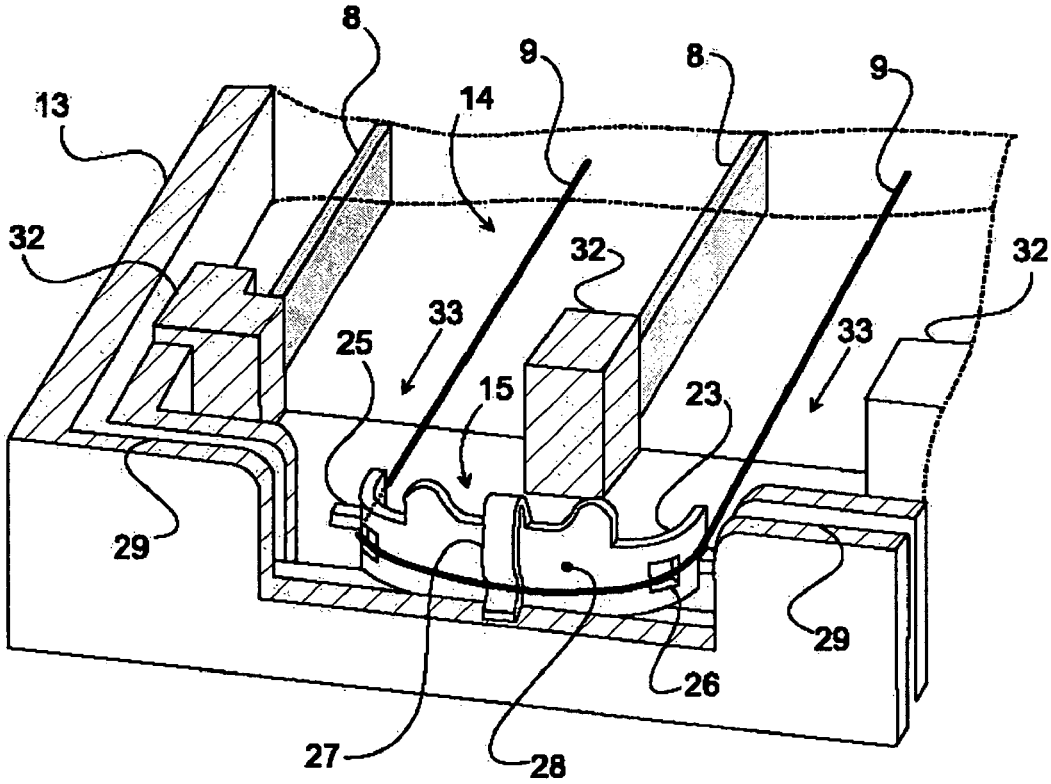
Figure 8:
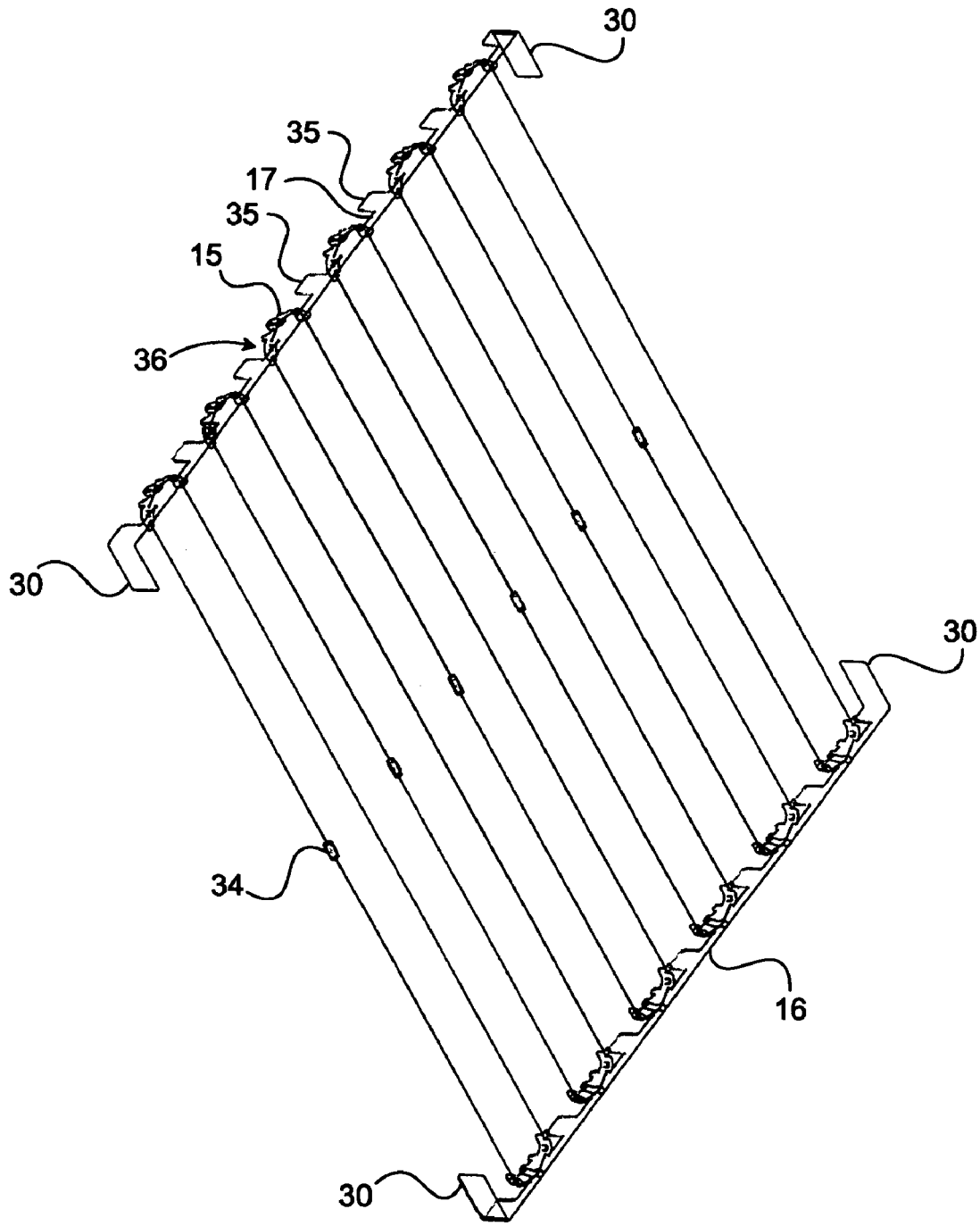
FIG. 8 is a perspective schematic view of a second set of electrodes included in the ionizing device shown in FIGS. 2 and 3.

More particularly, in FIGS. 5 and 8, the two free ends of the cable are made integral with one another by means of crimping 34, or in an equivalent way by means of welding or the like. An operation such as this is advantageously carried out on the factory floor prior to assembling the elements making up the ionizing device 2. In addition to the lateral positioning tabs 30, the supports 16, 17 comprise longitudinal tabs 35 designed to be inserted into the first grooves 29 that the chassis 13 comprises. The hooking fingers 15 are held by the support 16, 17 inside of clearance spaces 36 made between two longitudinal positioning tabs 35. After the supports 16, 17 have been fit onto the chassis 13, the clearance spaces 36 that they comprise are opposite slots 37 that the chassis 13 comprises, in order to create, within the thickness of the chassis 13, an access passage for the hooking fingers 15, and, when applicable, facilitate the placement of the wires previously looped around themselves.

Figure 9:
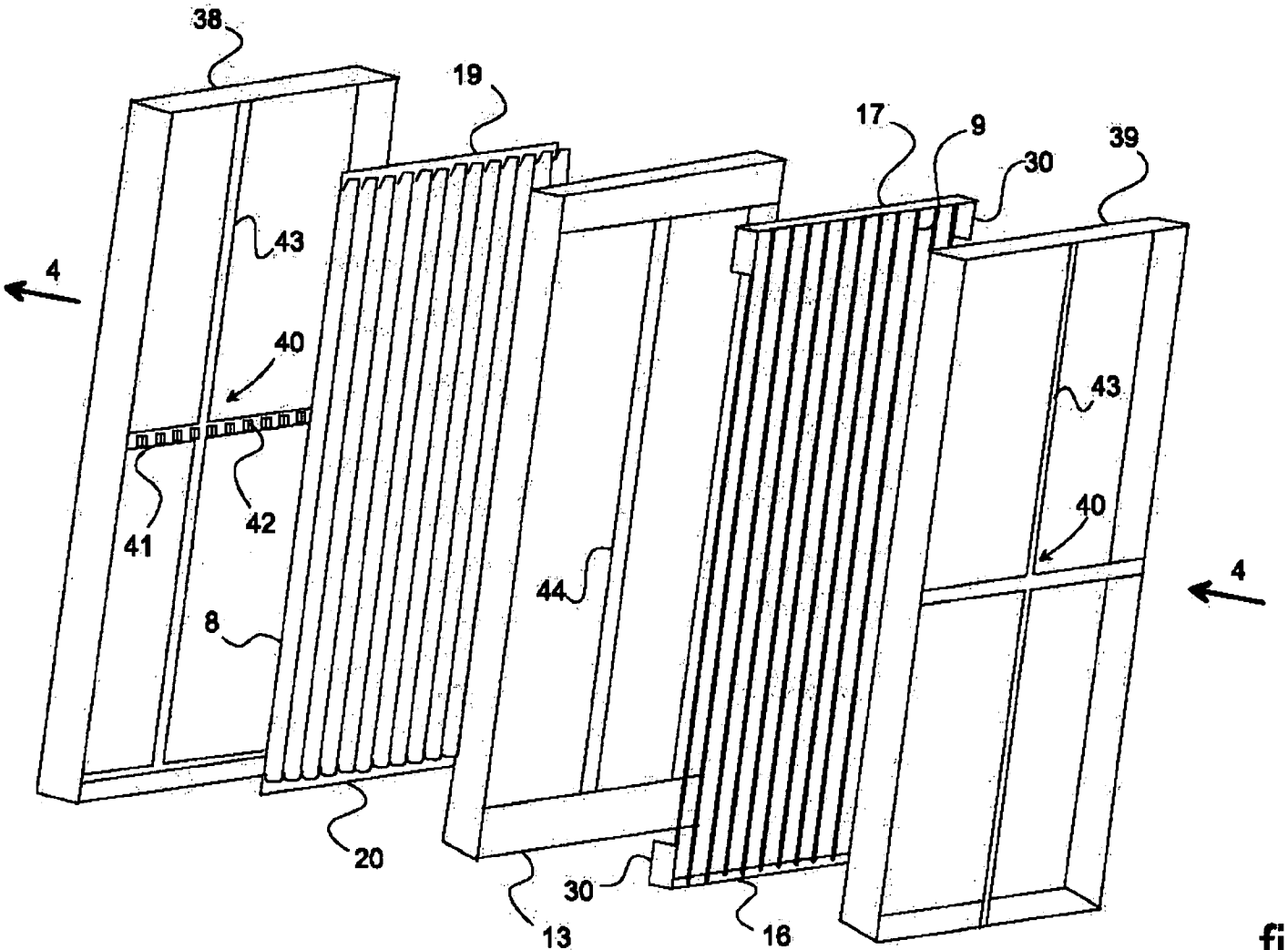
FIG. 9 is an exploded schematic perspective view of another embodiment of the device of the invention.

According to another embodiment of this invention shown in FIG. 9, the chassis is housed inside of a frame 38, 39 consisting of two basic frames 38, 39 interconnected by means of nesting, clipping, welding or the like. The basic frames 38, 39 are structurally similar and are produced by molding an electrically insulating material, in particular a plastic material. The large surface of at least one basic frame 39 is equipped with a protective screen preventing foreign objects of substantial size from unexpectedly passing through into the ionizing device 2, without impeding the air from circulating freely. This basic frame 39, in particular, is the one situated upstream within the airflow 4.

The basic frames 38, 39 each comprise a stiffening cross-brace 40. The transverse arm 41 of the cross-brace 40 of the basic frame 38, arranged in proximity to the first electrodes 8, comprises a harness 42 whose teeth are engaged with the latter 8, in order to optimize the held position of the first electrodes 8, by supplementing the hold at their ends by holding them at their center area. The longitudinal arms 43 of the cross-braces 40 of the basic frames 38, 39 are arranged opposite a stiffening rib 44 that the chassis 13 comprises, in order to minimize the obstacles to passage of the airflow 4 and, consequently, airflow losses, while at the same time stiffening both the basic frames 38, 39 and the chassis 13.

The assembly of such an ionizing device 2 is carried out in stages, which are few in number, simple and fast to carry out, but which nevertheless make it possible to obtain such an ionizing device 2 that is reliable and competitive to produce. A first stage consists in nesting said unitary piece 8, 19, 20 grouping together the first electrodes 8 inside of the second grooves 31 made in the chassis 13 and, in particular, inside the hubs 32 that the latter comprises. The cross-pieces 19, 20 advantageously constitute means of centering the first electrodes 8 on the chassis 13, in order to facilitate the assembly thereof. A second stage consists in nesting the supports 16, 17 carrying the fingers inside of the first grooves 29 made in the chassis 13. A third stage consists in hooking the ends of the loops 14 onto the fingers 15 that the supports 16, 17 comprise. In the case where the two supports 16, 17 are formed from a unitary piece, it is possible to position the loops 14 on the latter prior to it being nested on the chassis 13. A fourth stage consists in adding the basic frame 38 equipped with the harness 42 onto the chassis 13, and in closing the device by joining the other basic frame 39 to the first 38, by means of nesting, gluing, welding or the like.

The invention claimed is:

1. A device for ionizing (2) particles carried in an airflow (4) circulating inside a system, the device (2) including at least two electrodes (8, 9) held by a chassis (13) and connected, respectively, to corresponding terminals (10, 11) of a polarized electrical power supply, two adjacent first electrodes (8) being arranged on either side of a second electrode (9), the second electrode (9) being formed from at least one conductor cable (14), the conductor cable (14) being hooked onto fingers (15) that are designed as an elastic part for tensioning the conductor cable (14) and that are held by the chassis (13);

wherein the fingers (15) are designed in the form of a flexible strip; and wherein the conductor cable (14) extends from one edge to the other of the chassis (13), forming at least one loop whose strands each constitute the second electrode (9).

2. The device of claim 1 wherein the fingers (15) comprise lateral flanges (23) for engaging and supporting the conductor cable (14).

3. The device of claim 2 wherein the flanges (23) are provided with a pin (25) for holding the conductor cable (14).

4. The device of claim 2 wherein the flanges (23) are provided with a notch (26) for receiving the conductor cable (14).

5. The device as claimed in claim 1 wherein on their outside face, the fingers (15) comprise a flexible center strip (27) against which the conductor cable (14) rests.

6. The device of claim 1 wherein the fingers (15) constitute parts for positioning and holding the conductor cable (14) with regard to the distance separating two adjacent first electrodes (8).

7. The device of claim 1 wherein there are a plurality of conductor cables (14) and each forms a closed loop extending from one edge to the other of the chassis (13).

8. The device of claim 1 wherein the conductor cable (14) is successively sent back and forth from one edge to the other of the chassis (13) while forming a plurality of open loops.

9. The device of claim 1 wherein the hooking fingers (15) of at least one same end of the loops are assembled together on a support (16, 17) held by the chassis (13).

10. The device of claim 9 wherein the support (16, 17) is added onto the chassis (13) by nesting inside of a first groove (29) that the latter (13) comprises.

11. The device of claim 1 wherein the first electrodes (8) are each made in the form of a plate arranged in an overall perpendicular direction to the direction of the airflow (4), the width of the first electrodes (8) running parallel to the airflow (4).

12. The device of claim 1 wherein there are a plurality of first electrodes (8) and they are joined together at their ends by cross-pieces (19, 20) held by the chassis (13).

13. The device of claim 12 wherein the first electrodes (8) and the cross-pieces (19, 20) constitute a unitary piece.

14. The device of claim 1 wherein the chassis (13) is made in the form of a frame receiving a support (16, 17) at one of its large surfaces, and the unitary piece at its other large surface.

15. The device of claim 1 wherein the chassis (13) is electrically insulating.

16. The device of claim 1 wherein the chassis (13) is integrated into a functional unit of the system.

17. The device of claim 1 wherein the chassis (13) is housed inside of a frame (38, 39).

18. The device of claim 1 wherein the device is associated with another device for collecting (3) the particles by electrostatic precipitation, and with a pulser (7) generating the airflow (4).

19. A ventilation, heating and/or air conditioning system comprising a device for ionizing particles carried in an airflow, the device (2) including at least two electrodes (8, 9) held by a chassis (13) and connected, respectively, to corresponding terminals (10, 11) of a polarized electrical power supply, two adjacent first electrodes (8) being arranged on either side of a second electrode (9), the second electrode (9) being formed from at least one conductor cable (14), the conductor cable (14) being hooked onto fingers (15) that are designed as an elastic part for tensioning the conductor cable (14) and that are held by the chassis (13);

wherein the fingers (15) are designed in the form of a flexible strip; and wherein the conductor cable (14) extends from one edge to the other of the chassis (13), forming at least one loop whose strands each constitute the second electrode (9).

20. A self-contained ventilation, heating and/or air conditioning system for purifying the air inside the passenger compartment of a vehicle, which is separate from a primary ventilation, heating and/or air conditioning system equipping this vehicle, the self-contained ventilation, heating and/or air conditioning system comprising a device for ionizing particles carried in an airflow, the device (2) including at least two electrodes (8, 9) held by a chassis (13) and connected, respectively, to corresponding terminals (10, 11) of a polarized electrical power supply, two adjacent first electrodes (8) being arranged on either side of a second electrode (9), the second electrode (9) being formed from at least one conductor cable (14), the conductor cable (14) being hooked onto fingers (15) that are designed as an elastic part for tensioning the conductor cable (14) and that are held by the chassis (13);

wherein the fingers (15) are designed in the form of a flexible strip; and wherein the conductor cable (14) extends from one edge to the other of the chassis (13), forming at least one loop whose strands each constitute the second electrode (9).

* * * * *